US005553851A

United States Patent [19]

Malavazos et al.

[11] Patent Number: 5,553,851

[45] Date of Patent: Sep. 10, 1996

[54] REVOLVING RINGS GAMING APPARATUS

[75] Inventors: Alex Malavazos; Gregory Malavazos; Constantine Malavazos, all of San Leandro, Calif.

[73] Assignee: Quick Silver Development Co., Inc., San Leandro, Calif.

[21] Appl. No.: 443,213

[22] Filed: May 17, 1995

[51] Int. Cl.[6] ..... A63F 5/02; A63F 5/04; A63F 7/30

[52] U.S. Cl. ..... 273/142 E; 273/142 D; 273/142 HA; 273/119 R; 273/121 R; 273/122 R; 273/123 R; 273/124 R; 273/125 R; 273/115; 273/116; 273/117

[58] Field of Search ..... 273/142 E, 142 HA, 273/142 R, 142 A, 142 B, 142 C, 142 D, 142 F, 123 R, 124 R, 124 A, 118 R, 119 R, 113–117

[56] References Cited

U.S. PATENT DOCUMENTS

| | | | |
|---|---|---|---|
| 887,464 | 5/1908 | Creasey | 273/280 |
| 1,138,865 | 5/1915 | Hagerty | 273/142 G |
| 1,376,199 | 4/1921 | Gotsche | 273/138 R |
| 1,474,488 | 11/1923 | Nelson | 273/142 F |
| 1,537,236 | 5/1925 | Jarvis | 273/142 G |
| 1,977,814 | 10/1934 | Warner | 273/142 G |
| 2,081,255 | 5/1937 | Troth | 273/142 F |
| 3,166,323 | 1/1965 | Anderson | 273/142 R |
| 3,843,131 | 10/1974 | Stubbmann | 273/248 |
| 3,853,324 | 12/1974 | Reiner | 273/142 E |
| 5,102,135 | 4/1992 | Addiechi | 273/142 E |

*Primary Examiner*—Benjamin H. Layno
*Attorney, Agent, or Firm*—Harris Zimmerman

[57] ABSTRACT

Gaming apparatus in which a ball is traveled onto a revolving surface has a plurality of rings of differing diameters which jointly form the revolving surface. The rings are centered on a vertical axis of rotation and may rotate in opposite directions or in the same direction at different speeds. The rings have winning apertures and losing apertures through which a rolling ball may drop through the ring. The rings, other than the final ring along the path of travel of the ball, also have pass zones at which a ball may roll on to the next ring without dropping into an aperture. Progressively higher score values may be assigned to the winning apertures of the successive rings along the path of ball travel. In the preferred form, the apparatus includes a ball launcher and detectors for counting balls which drop through winning apertures.

20 Claims, 5 Drawing Sheets

Fig. 9
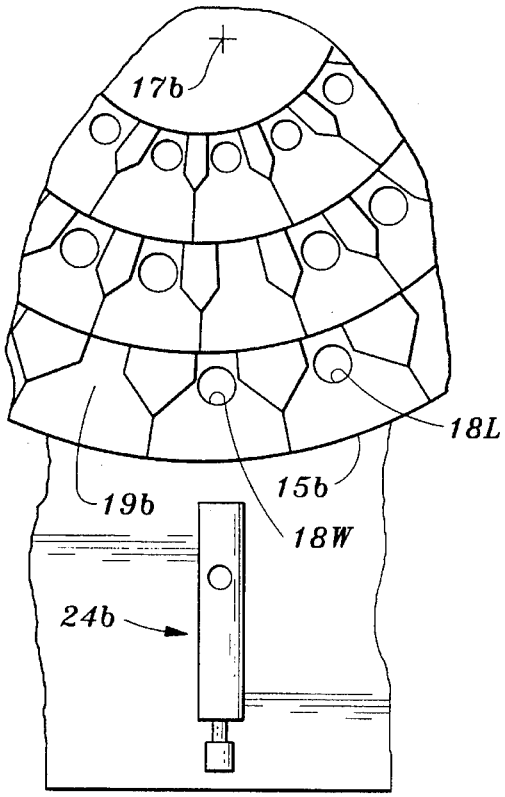
Fig. 10
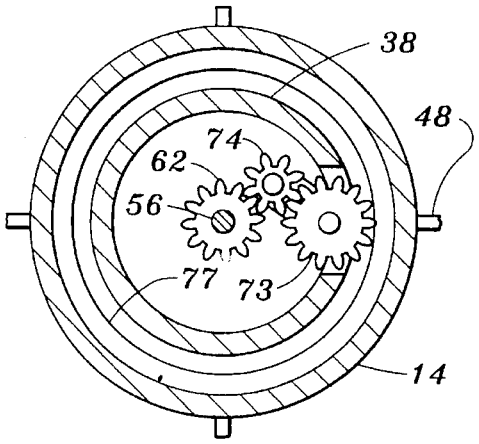
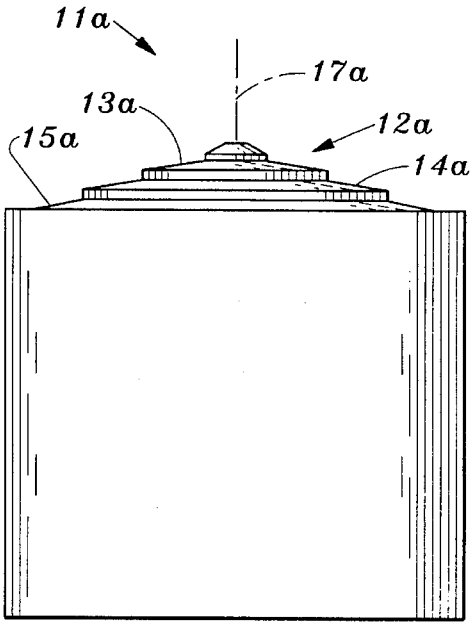
Fig. 11
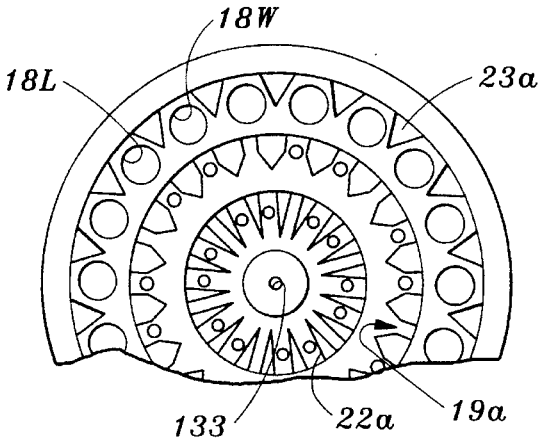
Fig. 12

REVOLVING RINGS GAMING APPARATUS

TECHNICAL FIELD

This invention relates to amusement devices and more particularly to gaming apparatus of the type at which a player's score or winnings is determined by the interaction between a rolling ball and a revolving surface.

BACKGROUND OF THE INVENTION

Gaming devices at which the outcome of play is subject at least partly to chance are highly popular sources of entertainment in arcades, casinos, in the home and elsewhere. Gaming activity is more enjoyable if a variety of different gaming devices are available. New forms of gaming apparatus that determine the outcome of play in a novel manner can make such activity much more exciting.

The outcome of play at certain gaming devices depends on the route taken by a rolling ball in relation to a rotating wheel or the like. The roulette wheel is a well known example of a gaming device of this kind.

Each play at prior gaming devices of this type is determined by a single event. In roulette, for example, the rolling ball comes to rest in a particular compartment on the wheel and the outcome of that game is immediately decided. Gaming devices of this kind would be more enjoyable and create more excitement if the routine which determines the outcome of play were itself variable in an unpredictable way.

The present invention is directed to overcoming one or more of the problems discussed above.

SUMMARY OF THE INVENTION

In one aspect the present invention provides gaming apparatus which includes at least one ball and at least a pair of rings of differing diameters which are centered on a vertical axis. A first of the rings has a plurality of spaced apart first apertures in the top surface of the ring, the apertures being of sufficient size to enable the ball to enter the apertures. A second of the rings has a plurality of second apertures in its top surface which are also of sufficient size to receive the ball. At least a portion of the first apertures are spaced apart to define pass zones at which the ball may roll across the top surface of the first ring without entering any of the first apertures. The first and second rings are positioned to enable travel of the ball across the first ring and onto the second ring when the path of travel of the ball is coincident with a pass zone. Support means enable rotation of the first ring relative to the second ring about the vertical axis.

In another aspect of the invention, gaming apparatus includes at least one ball and an outer ring, an intermediate ring and an inner ring of progressively smaller diameters. Each ring is centered on the same vertical axis of rotation and each is rotatable thereabout. Each ring has a circular array of spaced apart apertures which encircles the axis of rotation. The apertures are of sufficient size to enable the ball to drop into any of the apertures when the ball rolls thereover. At least some of the apertures of the outer and intermediate rings are spaced apart sufficiently to define radial pass zones along which which the ball may roll towards the axis without entering an aperture. A portion of the apertures are winning apertures and another portion of the apertures are losing apertures. The rings are positioned to enable rolling travel of the ball towards the axis on successive ones of the rings until such time as the ball drops into one of the apertures. Ring support means enables rotation of the rings including rotation of the intermediate ring relative to the outer and inner rings.

During a portion of a series of plays of the gaming apparatus, the outcome is determined immediately by a single event. The ball enters an aperture on the first ring that the ball encounters. This routine is varied in an unpredictable manner as the ball will at times roll completely across the first ring, at the location of a pass zone, and on to the next ring before it enters an aperture. Apertures of the second ring may, if desired, be assigned a higher scoring value than the apertures of the first ring. In the preferred form of the invention at least one additional rotating ring with pass zones is present to provide for the random occurrence of still another event before the outcome of the play is determined. These randomly occurring variations in the mode of play greatly increase enjoyment of gaming apparatus of the type in which a rolling ball interacts with a rotating surface.

The invention, together with further aspects and advantages thereof, may be further understood by reference to the following description of the preferred embodiments and by reference to the accompanying drawings.

BRIEF DESCRIPTION OF THE DRAWINGS

FIG. 9 is a view of a portion of the top of a modified form of the gaming apparatus which has a differing type of ball launcher.

FIG. 10 is a plan view illustrating a modified form of ring rotating mechanism for the gaming apparatus.

FIG. 11 is a side elevation view of another embodiment of the gaming apparatus.

FIG. 12 is a top view of a portion of the embodiment of FIG. 11.

DETAILED DESCRIPTION OF THE PREFERRED EMBODIMENTS

Figure 1:
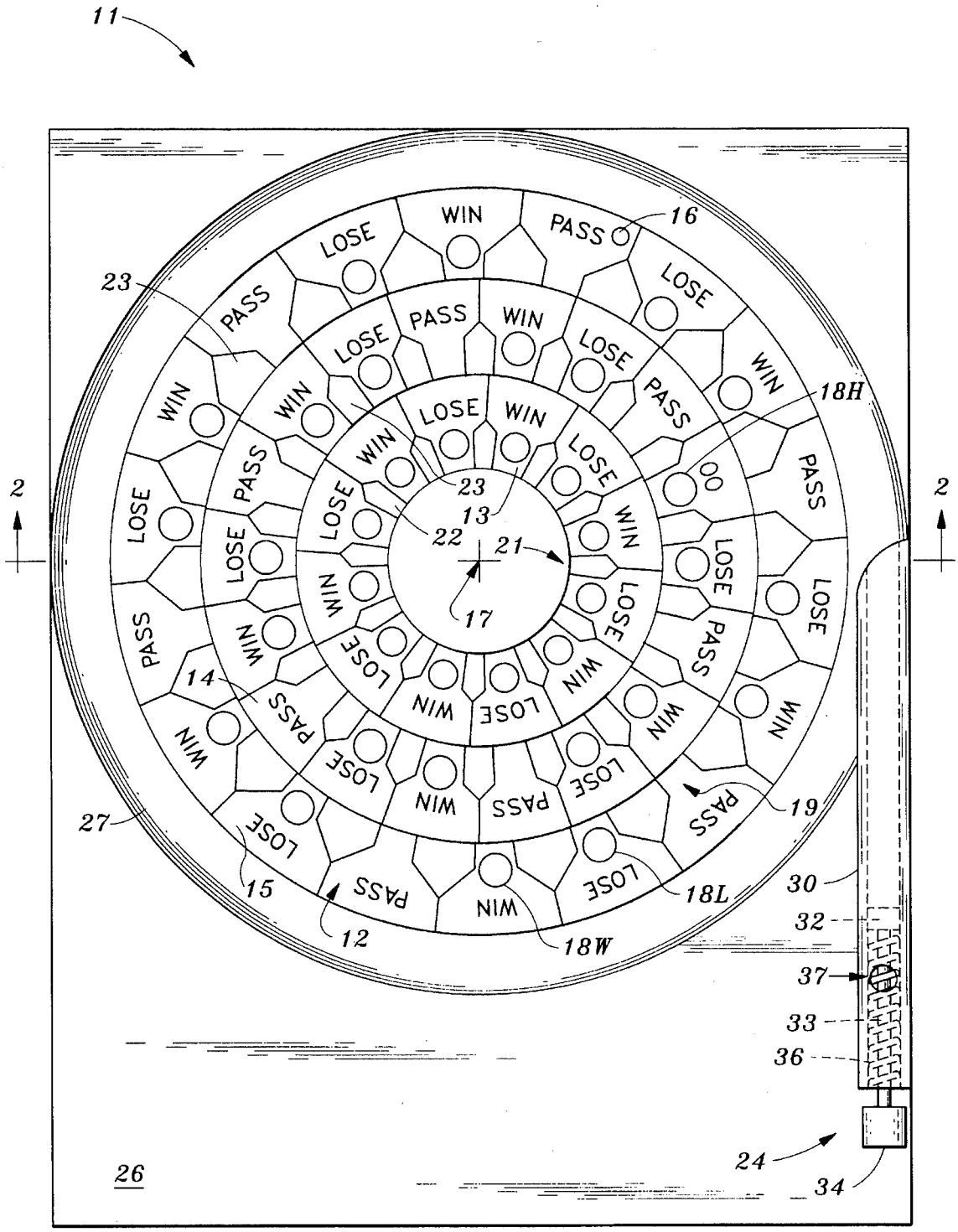
FIG. 1 is a plan view of gaming apparatus in accordance with a first embodiment of the invention.

Referring initially to FIG. 1, gaming apparatus 11 in accordance with the depicted embodiment of the invention has a playing surface 12 formed by three rings 13, 14 and 15 which are of progressively increasing diameter and which are centered on a vertical axis of rotation 17. During play a ball 16 is traveled onto the playing surface 12 and rolls towards the axis of rotation 17. Each ring 13, 14 and 15 has a plurality of spaced apart apertures 18W and 18L of sufficient size to receive the ball 16, the the apertures of each ring being arranged in a circular array that is concentric with the axis or rotation 17. Apertures 18W alternate with apertures 18L in each such circular array of apertures. For scoring purposes, apertures 18W are designated as being winning apertures and apertures 18L as losing apertures. In embodiments of the gaming apparatus 11 that are designed for commercial use in gambling casinos or the like, one or more of the apertures such as aperture 18H of the intermediate ring 14 may may be designated as "house" apertures. The proprietors receive the sum bet by a player if the ball 16 enters the house aperture 18H. It should be recognized that the invention is not limited to use as gambling apparatus. Players may simply be awarded a score value when the ball 16 enters a winning aperture 18W and no score or a minus score when the ball enters a losing aperture 18L.

The ball 16 in the depicted form of the invention initially travels onto the revolving outer ring 15 where it variously may enter a winning aperture 18W or a losing aperture 18L. Either event terminates that round of play. The game is made more exciting by the presence of the additional rotating rings 13 and 14 and by the presence of pass zones 19 on the outer and intermediates rings 15 and 14 which randomly extend the play by allowing the ball 16 to cross over the outer ring and onto the intermediate ring and, on occasion, to continue on to the inner ring. The pass zones 19 are sectors of the outer and intermediate rings 15 and 14, situated at angular intervals around those rings, at which no aperture 18W or 18L is present. The winning apertures 18W of the outer ring 15, the intermediate ring 14 and the inner ring 13 may have progressively higher score values.

Figure 2:
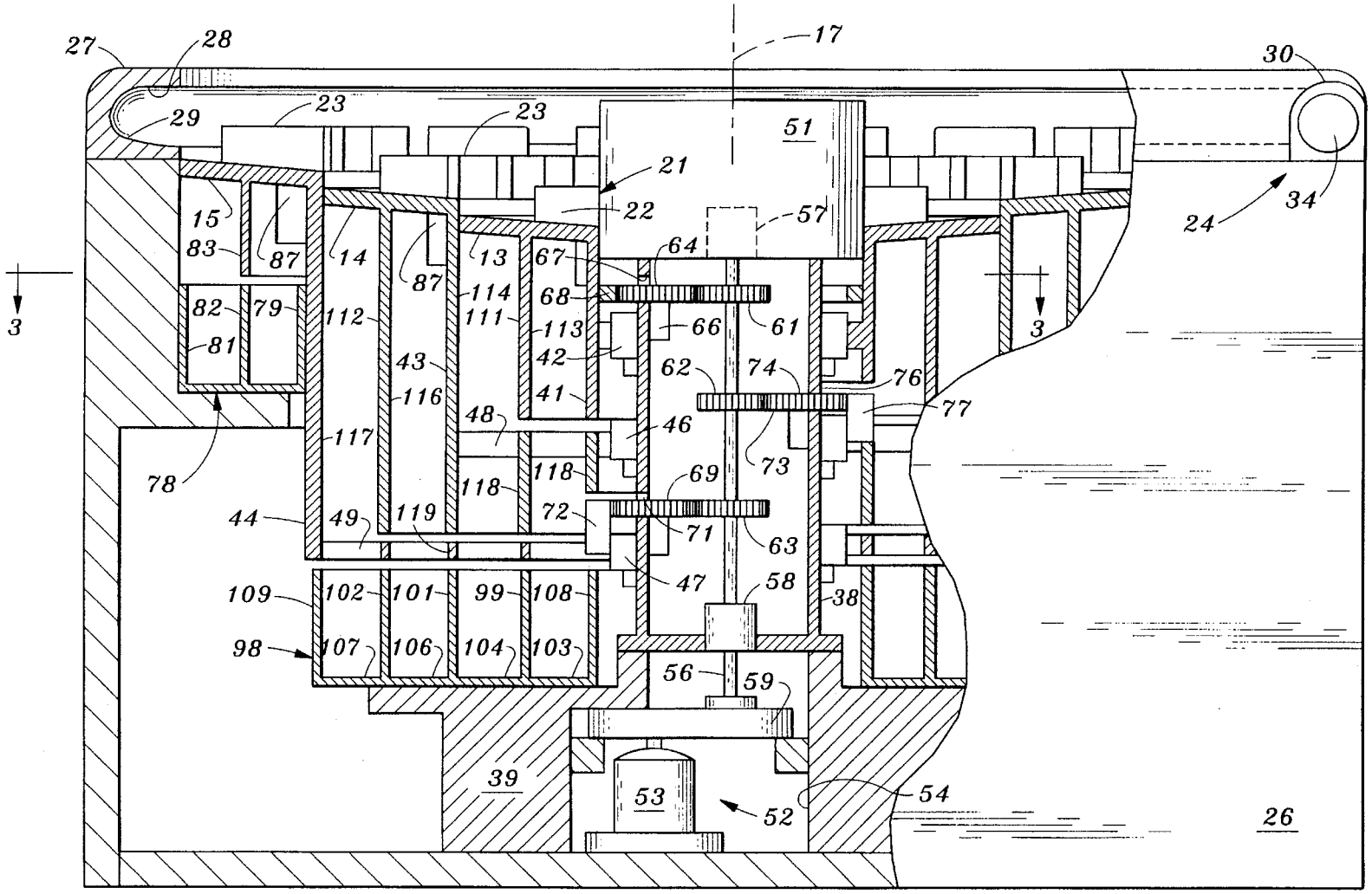
FIG. 2 is a broken out front elevation view of the gaming apparatus of FIG. 1, the broken out areas of FIG. 2 being a section view taken along line 2—2 of FIG. 1.

The inner ring 13 has no pass zones. Referring jointly to FIGS. 1 and 2, ball guiding means 21 on the inner ring 13 assures that the ball 16 will enter an aperture 18W or 18L and terminate the play when the ball arrives at the inner ring. The ball guiding means 21 in this example includes a series of radially directed raised fingers 22 on the top surface of the inner ring 13 which fingers are situated between the apertures 18W, 18L of the inner ring and which have pointed outer ends that force the ball 16 to travel over an adjacent one of the apertures 18W or 18L thereby assuring capture of the ball by an aperture.

The intermediate and outer rings 14 and 15 also have raised ball guides 23 situated between successive ones of the apertures 18W and 18L and between the apertures and pass zones 19, the guides again having pointed outer ends which guide the ball into an adjacent aperture or pass zone. The spacing of guides 23 from adjacent apertures 18W, 18L is smaller than the radius of the ball 16 thereby assuring that the ball will drop into an aperture rather than traveling along side of an aperture.

Referring again to FIG. 1 in particular, the inner and outer rings 13 and 15 of this embodiment are revolved in the same rotational direction but at different angular velocities by means which will hereinafter be described. The inner ring 14 is revolved in the opposite direction.

Certain of the above described characteristics of this embodiment of the invention are for purposes of example and can vary in other embodiments of the invention. In other embodiments there may be only two rings 14 and 15 or there may be more than the three rings of this example, In general, all rings other than the last ring along the path of travel of the ball 16 are provided with pass zones 19. Some of the rings may be stationary. The arrangement of apertures 18W, 18L and pass zones 19 may be varied. For example, one or more of the rings other than the last ring along the path of ball travel may have only losing apertures 18L and pass zones 19. The revolving rings 13, 14 and 15 may all turn in the same direction but at different speeds.

In the simplest form of the gaming apparatus 11 the revolving rings 13, 14 and 15 may be manually spun and the ball 16 may be manually rolled onto the playing surface 12. The apertures 18W, 18L may be cavities in the rings and scoring may be accomplished simply by noting the particular aperture in which the ball 16 comes to rest. In the preferred form of the invention, the rings 13, 14 and 15 are motor driven. The preferred gaming apparatus 11 has ball launching means 24 and the apertures 18W and 18L extend through the rings 13, 14 and 15. The captured ball 16 drops through a ring to enable automatic score tallying.

In particular, with reference again to both FIGS. 1 and 2. The rings 13, 14 and 15 may be situated at the top of a cabinet 26. The ball launching means 24 of this example of the invention is of a type which simulates the traditional pattern of releasing a ball onto a roulette wheel. For this purpose, a circular raceway 27 is secured to the top of cabinet 26 and encircles the periphery of the outer ring 15 at a location just above the ring 15. Raceway 27 forms a circular groove 28 that faces towards the axis of rotation 17 of the rings and which has a lower wall 29 that slopes downward towards the outer ring 15. A horizontal tube 30 at the top of cabinet 26 is disposed in tangential relationship with groove 28 and has an interior passage 31 that opens into the groove. A slidable plunger 32 in passage 31 is secured to an axial rod 33 which extends out of the front end of tube 30 and which connects with a knob 34. A compression spring 36 in passage 31 is compressed by plunger 32 when knob 34 is drawn outward from the front end of tube 29. A hole 37 in tube 30 enables entry of a ball 16 into the tube after the spring 36 has been compressed in this manner. Upon release of knob 34, spring 36 extends causing plunger 32 to propel the ball 16 into raceway groove 28.

Centrifugal force causes the ball 16 to travel a circular path along groove 28 for a period of time until the ball slows sufficiently to roll down the lower wall 29 of the groove and onto the outer revolving ring 15. The top surfaces of rings 13, 14 and 15 each slope downward in the direction of the rotational axis 17 and thus rolling of the ball continues until such time as it drops into an aperture 18W or 18L.

In a more automated version of the gaming apparatus 11, knob 34 of the ball launcher 26 may be replaced with an electrical actuator which responds to signals from a coin receiver or other source.

Figure 3:
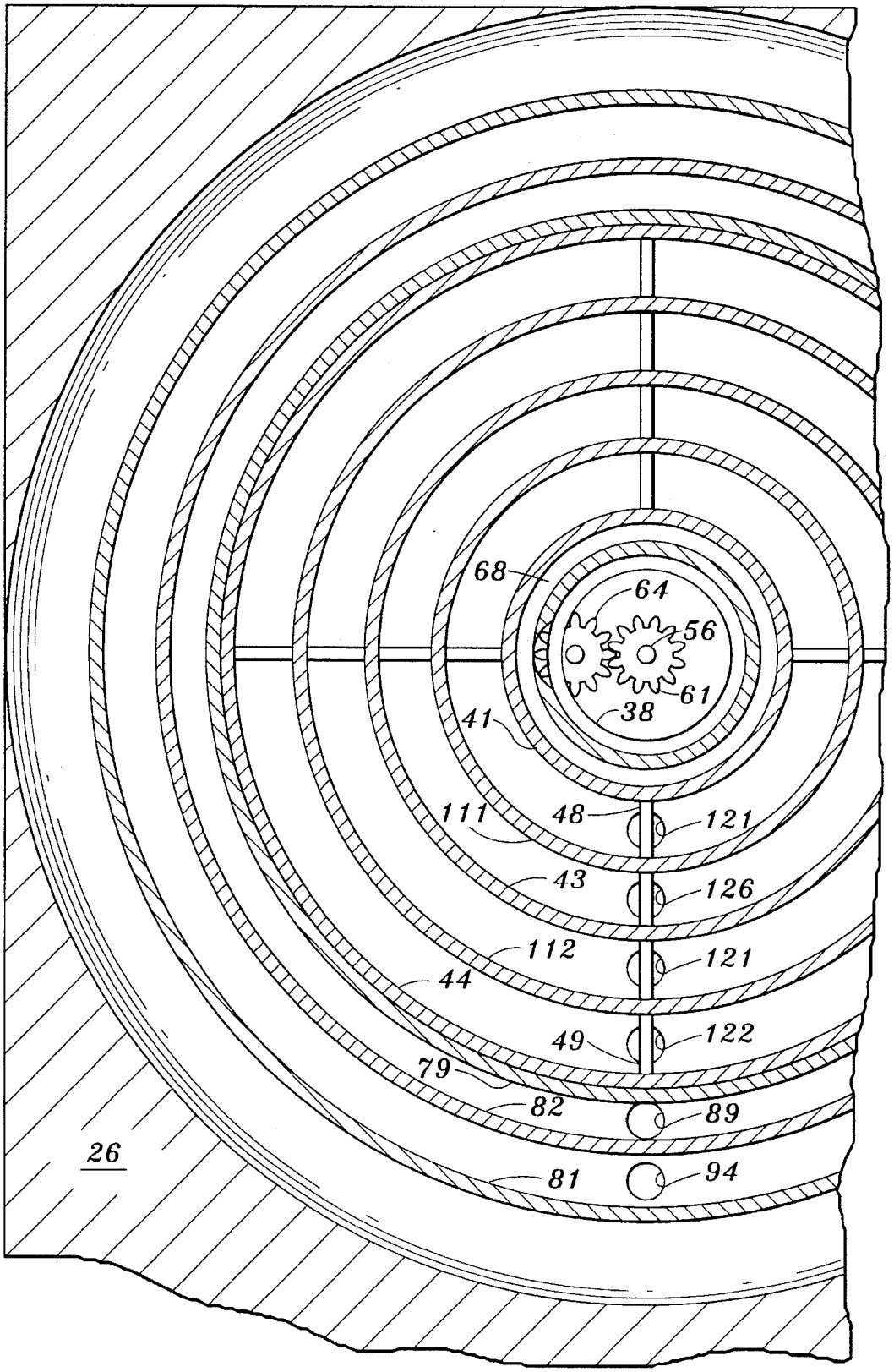
FIG. 3 is a plan section view of a portion of the gaming apparatus taken along line 3—3 of FIG. 2.

Referring jointly to FIGS. 2 and 3, the rings 13, 14 and 15 are supported by an upright cylinder 38 which extends upward from a support block 39 that is secured to the floor of cabinet 26. Inner ring 13 has a downward extending cylindrical sleeve 41 at the edge of the ring that is closest to axis 17, the sleeve being in coaxial relationship with support cylinder 38. A first annular bearing 42 couples sleeve 41 to cylinder 38 to support the inner ring 13 while enabling rotation of the ring.

The intermediate ring 14 and outer ring 15 also have downward extending coaxial sleeves 43 and 44 respectively at the edges of the rings which are closest to axis 17. Second and third annular bearings 46 and 47 respectively are secured to cylinder 38 in coaxial relationship therewith and support rings 14 and 15 respectively while enabling rotation of those rings. Sleeve 43 is connected to bearing 46 by a series of angularly spaced apart radial spokes 48 and sleeve 44 is connected to bearing 47 by another series of such spokes 49.

The upper end of support cylinder 38 is closed by a cylindrical center member 51 which has a diameter conforming to the inside diameter of the inner ring 13 and which extends upward through the inner ring.

Drive motor means 52 for rotating the rings 13, 14 and 15 includes an electrical motor 53 situated in a chamber 54 in support block 39. A drive shaft 56, supported by upper and lower bearings 57 and 58 respectively, extends along the axis of support cylinder 38 and is driven by motor 53 through a speed reducing gearbox 59. Three gears 61, 62 and 63 on shaft 56 respectively drive rings 13, 14 and 15. For this purpose, gear 61 engages with a first idler gear 64 which is supported by a journal bearing 66 that is secured to the inside surface of support cylinder 38. Idler gear 64 extends through a slot 67 in the wall of support cylinder 38 and engages a ring gear 68 that is secured to the inside surface of the sleeve 41 of inner ring 13 in coaxial relationship with the sleeve. Thus rotation of drive shaft 56 revolves the inner ring 13.

The outer ring 15 is turned by similar mechanism which includes another idler gear 69 engaged with drive shaft gear 63 and which extends out of support cylinder 38 through a slot 71 in order to engage another ring gear 72 that is secured to spokes 49 and which is in coaxial relationship with the outer ring. Thus the outer ring 15 turns in the same direction as the inner ring 13 in this embodiment of the invention. Rings 13 and 15 may be arranged to turn at the same speed or at different speeds by proportioning the drive gears 61 and 63 and/or the ring gears 68 and 72 to effect the desired result. In this example ring gear 72 has a diameter slightly greater than the diameter of ring gear 68. Thus inner ring 13 revolves at a faster rate than outer ring 15.

The intermediate ring 14 of this embodiment revolves in a direction opposite to the rotation of the inner and outer rings 13 and 15. For this purpose, with reference to both FIGS. 2 and 10, a rotation reversing gear 73 engages the intermediate drive gear 62 and also engages an additional gear 74 which extends through another slot 76 in the wall of support cylinder 38. Gear 74 engages another ring gear 77 which is secured to spokes 48 and which is in coaxial relationship with the inner ring 14.

Figure 4:
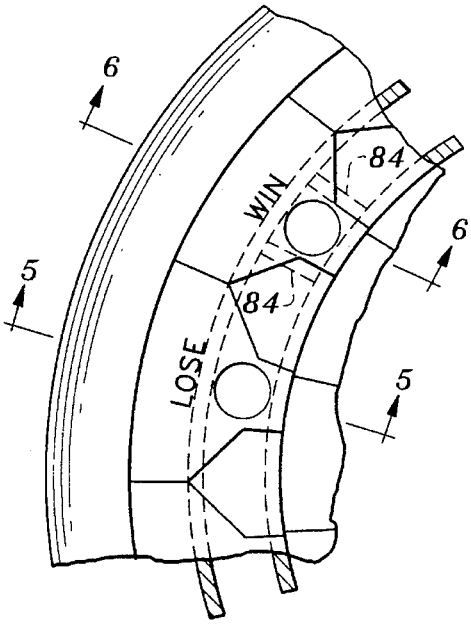
FIG. 4 is an enlarged view of the portion of FIG. 1 that is enclosed by dashed line 4 thereon.
Figure 5:
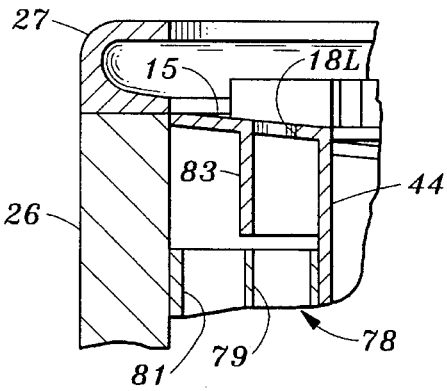
FIG. 5 is a cross section view taken along line 5—5 of FIG. 4.
Figure 6:
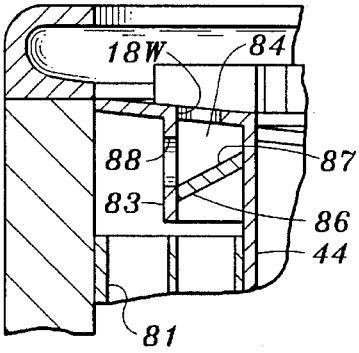
FIG. 6 is a cross section view taken along line 6—6 of FIG. 4

Referring again to FIGS. 2 and 3, balls which enter the apertures 18W, 18L of the outer ring 15 drop into a first circular ball collection trough 78 which is situated below the outer ring. Trough 78 is divided into two ball chutes 79 and 81 by a circular vane 82 which extends upward from the base of the trough. The outer ring has a circular vane 83 of similar diameter which extends down towards vane 82 of the trough. Referring now to FIGS. 4 and 5, balls which drop through one of the losing apertures 18L of outer ring 15 drop directly to the underlying ball chute 79. Referring now to FIGS. 4 and 6, the outer ring 15 has downward extending wall members 84 which extend between sleeve 44 and vane 83 of the ring and which are situated at each side of each winning aperture 18L. Floors 86 extend between the lower ends of the two wall members that are adjacent each winning aperture 18W. Thus the sleeve 44, vane 83, wall members 84 and floors 86 jointly form a series of ball receiving compartments 87 each of which is below a separate one of the winning apertures 18W.

The floor 86 of each such compartment 87 slants down towards one of a series of openings 88 in ring vane 83. Winning balls which enter a compartment 87 roll down through the adjacent opening 88 and are dropped into the outermost chute 81 of collection trough 78.

Figure 7:
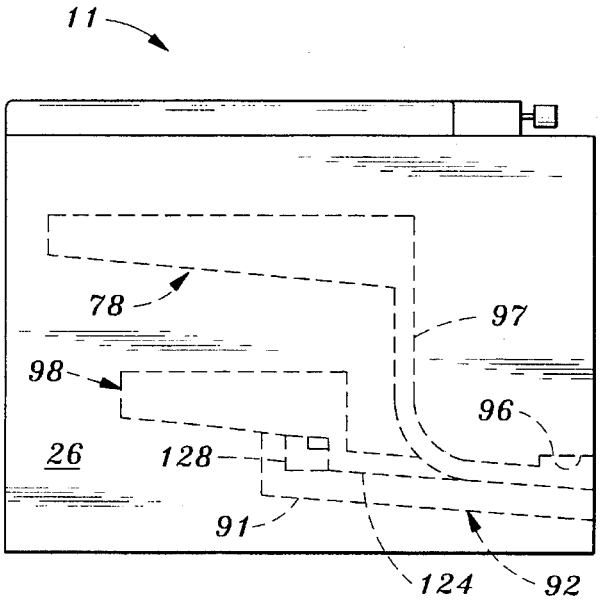
FIG. 7 is a side view of the gaming apparatus of the preceding figures.
Figure 8:
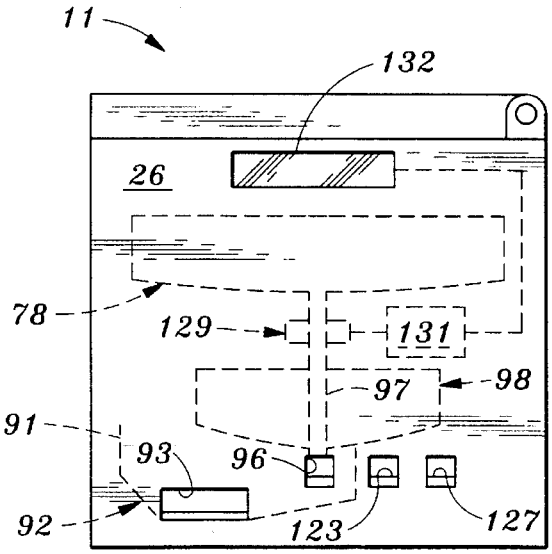
FIG. 8 is a front elevation view of the apparatus of the preceding figures.

Referring jointly to FIGS. 3 and 7, collection trough 78 becomes progressively deeper towards the front of cabinet 26. Thus a ball which drops into either chute 79, 81 if the trough 78 rolls to the front portion of the trough. Losing balls in chute 79 then drop through an opening 89 in the floor of the chute. Referring to FIGS. 7 and 8, the losing balls fall into a ball retrieval pan 91 which has a floor 92 that is sloped to direct the balls to a losing ball retrieval gate opening 93 at the front face of cabinet 26.

Referring again to FIGS. 2 and 3, a winning ball from outer ring 15 that rolls to the front of chute 81 as previously described then drops through an opening 94 in the floor of that chute. Referring to FIGS. 7 and 8, the winning ball then travels to an outer ring winning ball retrieval gate opening 96, at the front of cabinet 26, through a downward and forward extending tube 97.

Referring again to FIGS. 2 and 3, a second circular ball collection trough 98 is situated underneath the inner and intermediate rings 13 and 14 at a location immediately below spokes 49. Trough 98 has three spaced apart circular vanes 99, 101 and 102 of progressively increasing diameters that extend upward from the floor of the trough and which divide the trough into four concentric ball retrieval chutes 103, 104, 106 and 107. The cylindrical inner wall 108 of trough 98 is in alignment with the sleeve 41 of inner ring 13 and the cylindrical outer wall 109 of the trough aligns with the sleeve 44 of outer ring 15. Vane 101 of the trough 98 is in alignment with sleeve 43 of the intermediate ring 14. Inner ring 13 has a downward extending cylindrical vane 111 that aligns with vane 99 of trough 98 and the intermediate ring 14 has a cylindrical vane 112 that is in alignment with vane 102 of the trough. Thus the sleeves 41 and 43 and vane 111 jointly define a pair annular ball passages 113 and 114 under inner ring 13 through which balls may drop to compartments 103 and 104 respectively of collection trough 98. Sleeves 43 and 44 and vane 112 jointly define another pair of annular ball passages 116 and 117 through which balls may drop to trough compartments 106 and 107 respectively.

Sleeve 41 and vane 111 of the inner ring 13 terminate just above spokes 48. Ball passages 113 and 114 are made continuous by additional cylindrical vanes 118 which are secured to the spokes 48 and by cylindrical vanes 119 secured to the lower spokes 49. Additional vanes 119 secured to the lower spokes 49 align with sleeve 43 and vane 112 of the inner ring to make ball passages 116 and 117 continuous.

Referring to FIGS. 1 and 2, balls which enter a losing aperture 18L of inner ring 13 drop to compartment 103 through passage 113 and balls entering a losing aperture of the intermediate ring 14 drop to compartment 106 through passage 114. The inner and intermediate rings 13 and 14 each have ball receiving compartments 87 below their winning apertures 18W that are similar to the corresponding components of the outer ring as previously described with reference to FIGS. 4 and 6. Thus a ball which enters a winning aperture at inner ring 12 is deflected through an opening in vane 111 and drops to compartment 104 through annular passage 114. A ball entering a winning aperture of the intermediate ring 14 enters passage 117 and drops to compartment 107.

Referring to FIGS. 3, 7 and 8, the second ball collection trough 98 becomes progressively deeper towards the front of cabinet 26. Thus collected balls roll towards the front of the trough 98. Losing balls drop into the ball retrieval pan 91 through openings 121 at the lowest portions of compartments 103 and 106 of the trough 98. Winning balls in compartment 107 of the trough fall into a hole 122 at the lowest portion of the compartment and roll to an intermediate ring winning ball retrieval gate opening 123, at the front of cabinet 26, through an inclined tube 124. Inner ring winning balls in compartment 104 drop through another hole 126 and roll to another winning ball retrieval gate opening 127, at the front of cabinet 26, through another inclined tube 128.

Referring to FIG. 7 and 8 in particular, providing separate ball retrieval openings 96, 123 and 127 enables tallying of a player's score in instances where the score value of a winning ball depends on the particular ring at which it was intercepted. All winning balls may be delivered to a single retrieval opening if all have equal score values. Score tallying can also be done electronically by providing ball detectors 129 at the tubes 97, 124 and 128 through which winning balls travel to a retrieval gate, only one such detector being shown in the drawings. The detectors 129 may be of any of the known types such as trip switches or photoelectric detectors that transmit an electrical pulse to a pulse counter 131 in response to passage of an object. A flat panel display screen 132 can be coupled to the counter 131 to display a players score at the front of cabinet 26.

The gaming apparatus 11 can be operated while using only a single ball but faster operation is possible if a plurality of balls are provided making it unnecessary to wait for a played ball to reappear at a retrieval gate opening before continuing. While the above described embodiment of the invention requires manual transfer of balls from the retrieval gates 93, 96, 123 and 127 to the ball launching means 24, it possible to provide automatic ball return mechanism of the known kind for this purpose.

Referring again to FIG. 2, the revolving rings 13, 14 and 15 of the above described embodiment of the invention slope downward in the direction of the axis of rotation 17 of the rings to assure that a ball will roll towards the axis. Referring now to FIGS. 11 and 12, the rings 13*a*, 14*a* and 15*a* can slope in the opposite direction if balls are launched onto the playing surface 12*a* through an opening 133 situated at the axis of rotation 17*a*. In this form of the invention, the ball initially rolls onto the inner ring 13*a* and then travels outward across the intermediate ring 14*a* and onto the outer ring 15*a* if it is not captured by a winning aperture 18W or losing aperture 18L in the course of such travel. Pass zones 19*a* are present on the inner ring 13*a* and intermediate ring 14*a* while the outer ring 15*a* has only winning apertures 18W and 18L. The raised ball guides 22*a*, 23*a* which channel the ball over apertures 18W, 18L or into pass zones 19*a* and which are shown in FIG. 12 are not depicted in FIG. 11 in order to avoid obscuring of the profile of the rings 13*a*, 14*a* and 15*a*. Except as described above, the gaming apparatus 11*a* of FIGS. 11 and 12 may be similar to the previously described embodiment of the invention.

In the previously described forms of the invention, the outcome of the game is purely a matter of chance. Many persons enjoy games in which the player skill can affect the outcome of the game at least to some extent. Referring to FIG. 9, this can be accomplished by eliminating the ball raceway of the first described embodiment of the invention and by repositioning the ball launcher means 24*b* at a location where it is aimed at the outer revolving ring 15*b*. Preferably the ball launching means 24*b* travels the ball directly towards the axis of rotation 17*b* of the rings. In this embodiment, the player may endeavor to operate the ball launching means 24*b* at a time which will cause the ball to enter a pass zone 19*b* of the outer ring 15*b* rather than an aperture 18W, 18L of the outer ring.

While the invention has been described with reference to certain specific embodiments for purposes of example, many modifications and variations of the gaming apparatus are possible and it is not intended to limit the invention except as defined in the following claims.

We claim:

1. Gaming apparatus comprising a ball, at least a pair of rings of differing diameters which rings are centered on a vertical vertical axis, a first of said rings having a first top surface and having a plurality of spaced apart first apertures which are of sufficient size to enable said ball to enter said first apertures, a second of said rings having a second top surface and having a plurality of second apertures which are of sufficient size to enable said ball to enter said second apertures, at least a portion of the apertures of said second plurality thereof being spaced apart to define pass zones at which said ball may roll across said second top surface without entering one of said second apertures, said first and second top surfaces being positioned to enable travel of said ball across said second top surface at said pass zones and onto said first top surface, and support means for enabling rotation of said second ring relative to said first ring about said vertical axis.

2. The apparatus of claim 1 wherein said second apertures are situated in a circular array thereof on said second ring which circular array is centered on said vertical axis and wherein said pass zones of said second top surface extend radially thereon at locations which are between neighboring ones of said second apertures.

3. The apparatus of claim 1 wherein said second apertures are situated in a circular array which is centered on said vertical axis, further including a plurality of ball guides on said second top surface of said second ring including ball guides disposed between successive ones of said second apertures and ball guides disposed between ones of said second apertures and adjacent ones of said pass zones of said second top surface.

4. The apparatus of claim 3 wherein said ball guides that are disposed between successive ones of said second apertures have a configuration which guides said ball into an adjacent one of said second apertures and wherein said ball guides that are disposed between ones of said second apertures and adjacent ones of said pass zones have a configuration that guides said ball along the pass zones.

5. The apparatus of claim 1 wherein said second apertures are situated in a circular array which is centered on said vertical axis, further including a plurality of radially extending ball guides on said second top surface of said second ring, said ball guides being at locations thereon which are between successive ones of said second apertures of said array thereof and at locations that are between ones of said second apertures and ones of said pass zones, said ball guides having end surfaces which face said first ring and which are convergent towards said second apertures and towards said pass zones.

6. The apparatus of claim 1 wherein said first ring has ball guiding means for assuring that said ball enters one of said first apertures after said ball travels onto said first ring.

7. The apparatus of claim 1 wherein said second apertures are situated in a circular array which is centered on said vertical axis, said second apertures being arranged in successive pairs and wherein one of said pass zones is situated between each of said successive pairs.

8. The apparatus of claim 1 wherein said support means enables rotation of both of said first and second rings.

9. The apparatus of claim 8 further including drive motor means for rotating said first and second rings in opposite directions.

10. The apparatus of claim 8 further including drive motor means for rotating said first and second rings in the same direction at different speeds.

11. The apparatus of claim 1 wherein said first plurality of apertures includes a first group of apertures characterized as winning apertures interspersed with apertures of a second group which are characterized as losing apertures, further including means for detecting and counting entries of a ball into any of said winning apertures.

12. The apparatus of claim 1 wherein said second ring is of greater diameter than said first ring and wherein said second top surface has a frusto-conical shape and slopes towards said first ring.

13. The apparatus of claim 1 wherein said first ring is of greater diameter than said second ring and wherein said first top surface has a frusto-conical shape and slopes towards said second ring.

14. The apparatus of claim 1 further including a third ring centered on said vertical axis having a third top surface and having a diameter greater than the diameter of the largest of said first and second rings, said third ring having a plurality of spaced apart third apertures which are of sufficient size to enable said ball to enter said third apertures, said third top surface being positioned to enable travel of said ball from one of said second and third top surfaces to the other thereof and wherein said support means enables rotation of said third ring relative to said second ring.

15. The apparatus of claim 1 wherein said second ring has a diameter that is larger than the diameter of said first ring, further including a circular ball raceway centered on said vertical axis and having a diameter that is larger than the diameter of said second ring, said raceway having a groove which extends around the periphery of said second ring and which has an open side facing in the direction of said second ring.

16. The apparatus of claim 15 further including means for selectively propelling said ball along said groove of said raceway.

17. The apparatus of claim 1 further including means for selectively propelling said ball towards said second top surface along a path which is directed towards said second top surface.

18. The apparatus of claim 1 wherein said first top surface of said first ring is the upper surface of a first annular ring member and wherein said first apertures extend through said first annular ring member, said second top surface of said second ring being the upper surface of a second annular ring member wherein said second apertures extend through said second annular ring member, a portion of said first and second apertures being characterized as winning apertures and another portion thereof being characterized as losing apertures, further including ball receiver means for collecting balls which drop through said losing apertures, a plurality of chutes positioned to intercept balls which pass through said winning apertures, means for detecting and counting balls which are intercepted by said chutes which means delivers the detected balls to said ball receiver means.

19. Gaming apparatus comprising at least one ball, an outer ring and an intermediate ring and an inner ring of progressively smaller diameters, each of said rings being centered on the same vertical axis of rotation and being rotatable thereabout, each of said rings having a circular array of spaced apart apertures which encircles said axis, the apertures being of sufficient size to enable said ball to drop into said apertures when said ball rolls thereover, at least some of the apertures of said outer and intermediate rings being spaced apart sufficiently to define radial pass zones thereon along which said ball may roll towards said axis without entering an aperture, a portion of the apertures on each of said rings being winning apertures and another portion of the apertures on each of said rings being losing apertures, said rings being positioned to enable rolling travel of said ball towards said axis on successive ones of said rings until such time as the ball drops into one of said apertures and ring support means for enabling said rotation of said rings including rotation of said intermediate ring relative to said outer and inner rings.

20. The apparatus of claim 19 further including motorized drive means for rotating said rings, ball launching means for propelling said ball along a path of travel which carries said ball to said outer ring and means for detecting and indicating dropping of said ball into any of said winning apertures.

* * * * *